United States Patent [19]

Thomas

[11] 4,078,634

[45] Mar. 14, 1978

[54] LIFT APPARATUS AND SAFETY BRACKET USABLE THEREWITH

[75] Inventor: William J. Thomas, Glenside, Pa.

[73] Assignee: Standard Pressed Steel Co., Jenkintown, Pa.

[21] Appl. No.: 689,616

[22] Filed: May 24, 1976

[51] Int. Cl.[2] ..... B66B 5/16

[52] U.S. Cl. ..... 187/89; 187/90; 188/188; 188/189

[58] Field of Search ..... 187/81, 86, 89, 90, 187/88, 82; 188/188, 189; 212/1

[56] References Cited

U.S. PATENT DOCUMENTS

| | | | |
|---|---|---|---|
| 805,300 | 11/1905 | Keeley | 187/82 |
| 1,173,722 | 2/1916 | Kurz | 187/82 |
| 2,490,653 | 12/1949 | Sahlin | 187/90 |
| 2,944,635 | 7/1960 | Wittkuhns | 187/89 |
| 3,232,382 | 2/1966 | Buck | 187/89 |

*Primary Examiner*—Lawrence J. Oresky

*Attorney, Agent, or Firm*—Andrew L. Ney; Aaron Nerenberg

[57] ABSTRACT

In the preferred embodiment of the invention disclosed herein a lift apparatus includes a load carriage movable along a mast member by a hoist means including a cable supporting the load carriage and connected to a drive means. Also included is a safety brake including brake means operative to apply a braking force between the load carriage and the mast member and for supporting the load carriage on the mast member when the brake means is in its operative condition. In accordance with the invention, the brake means is controlled through an operating member which is actuated by either a first or second actuating means, each of which is independent of the other. The first actuating means is arranged to operate the brake means if the cable supporting the load carriage fails and the second actuating means is arranged to operate the brake means in response to an over-speed condition created by other failures in the hoist means.

14 Claims, 3 Drawing Figures

FIG. 2.
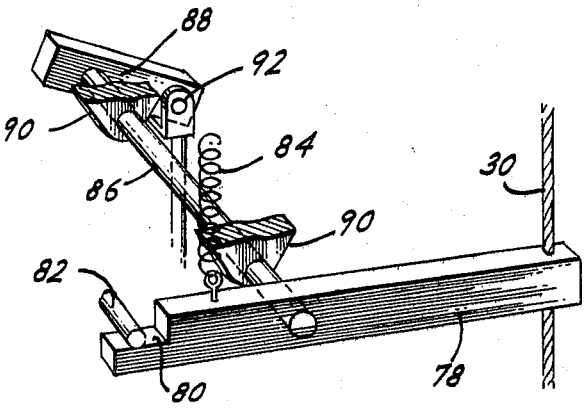
FIG. 1.
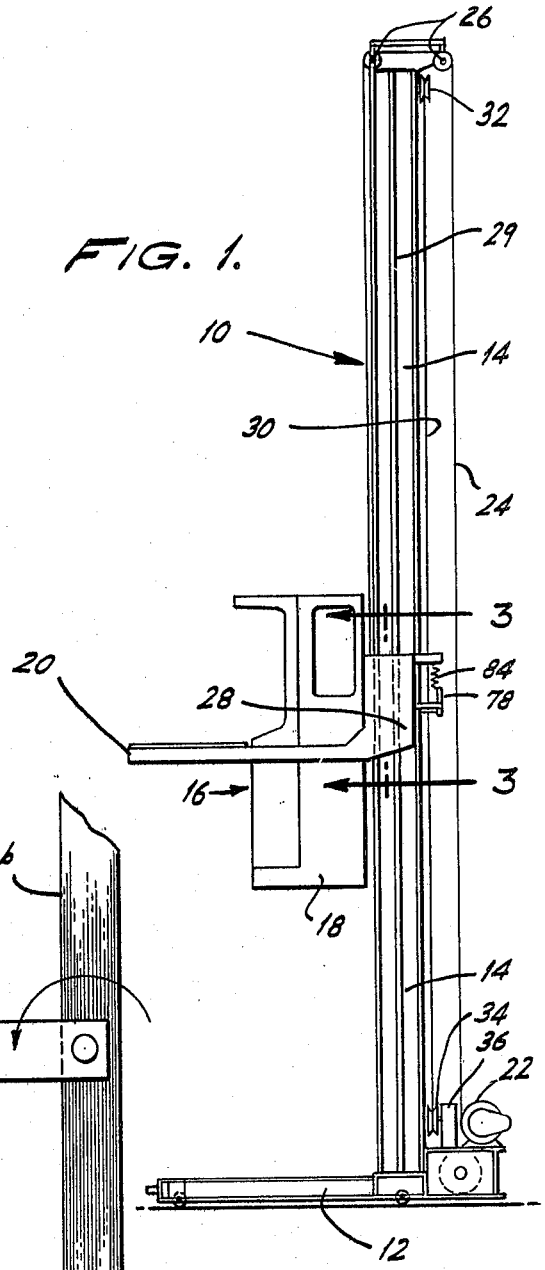
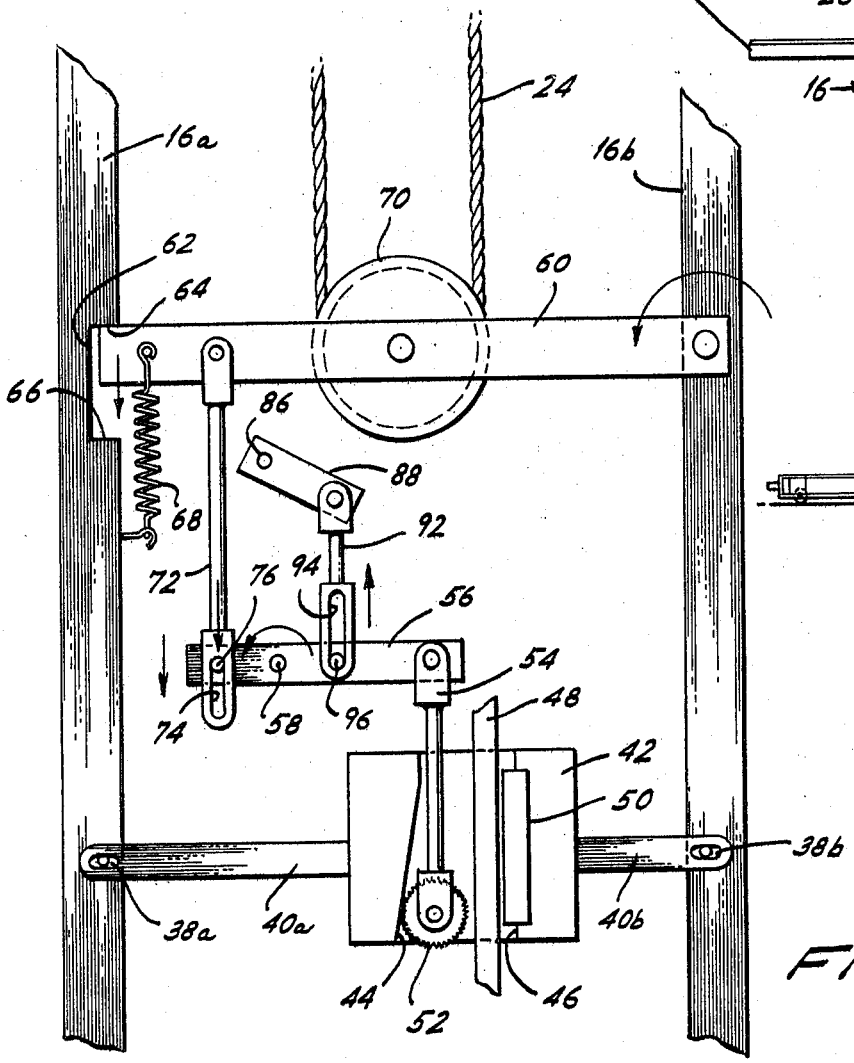
FIG. 3.

LIFT APPARATUS AND SAFETY BRACKET USABLE THEREWITH

This invention relates to a lift apparatus including an improved safety brake arrangement and also to a particular safety brake arrangement useful in a lift apparatus or similar devices.

Various types of lift apparatus are used to raise and lower people in the performance of a large variety of work functions. For example, in a warehouse type operation wherein a large number of small parts are stored in storage spaces formed by vertically arranged shelving units, it has become usual to provide a lift apparatus, commonly referred to as an order picker, to facilitate the delivery of parts from a storage space to a delivery point or from a receiving point to a storage space. Lift apparatus of the type noted usually includes a base member including means for moving the apparatus along the ground and further includes a generally vertical mast associated with a load carriage and a hoist means for moving the load carriage vertically along the mast. The load carriage includes a cab in which an operator is carried and a storage tray on which the parts are carried during transport. In use, the operator drives the apparatus along aisles formed by the shelving units and when a desired location is reached, operates the hoist means to lift the load carriage to the appropriate storage space from which the parts are then extracted or delivered.

By using lift apparatus of the type described, greater efficiencies have been realized in warehouse operations because it permits greater utilization of vertical space. Typically, the shelving units forming the storage spaces can be arranged to extend thirty feet above the ground. At these heights it should be understood that failure or malfunction of the hoist means with a resultant uncontrolled fall of the load carriage downwardly along the mast presents a high risk of serious injury to the operator. Thus, it is usual to provide a safety brake means between the load carriage and the mast which is operative to stop movement of the load carriage and to support it on the mast in the event of an emergency.

Usually, operation of the safety brake means is controlled by the detection of an over-speed condition, that is, the safety brake means is operative only when the speed of the load carriage downwardly along the mast exceeds a predetermined speed. Normally the predetermined speed is somewhat higher than the normal operating speed of the load carriage along the mast. Thus, should the hoist means fail or otherwise malfunction the load carriage will accelerate downwardly along the mast until it reaches the predetermined speed. At this point, an over-speed detector operates the safety brake means. Between the sensing of the predetermined speed by the over-speed detector and the application of the safety brake means there is a time lag during which the various components of the over-speed detector and the safety brake means are operating. This time lag does not usually present any particular problem when the failure in the hoist mechanism is of the type wherein the movement of the load carriage downwardly along the mast is resisted by various inertial, friction or other drag forces. The noted forces prevent the rapid acceleration of the load carriage along the mast so that the speed of the load carriage has not exceeded the predetermined speed to any significant extent when the safety brake means is applied. If, however, the cable supporting the load carriage fails, the only resistance to movement of the load carriage is the friction between the carriage and the mast, which is relatively slight so that the load carriage may be considered to be essentially freefalling. As a result the load carriage accelerates rapidly along the mast so that during the above-noted time lag its speed increases significantly and significantly exceeds the predetermined speed when the brake means is applied. It can thus be seen that if the cable fails the load carriage is stopped in an abrupt manner which can cause the operator to lose his balance or otherwise be tossed about in the cab which can cause injury. Further, such an abrupt stop could cause the parts carried on the load tray to fall from the load tray to the ground which could result in injury to other workers on the floor of the warehouse.

Accordingly, it is an object of this invention to provide lift apparatus including safety brake means controlled by a plurality of independent actuating means each responsive to a different mode of failure.

It is another object of this invention to provide a lift apparatus including a safety brake mechanism including first means operative to apply the brake in response to a failure of the cable supporting the load carriage and second means operative to apply the brake in response to other failures causing an overspeed condition.

It is still another object of this invention to provide a lift apparatus including a support cable and safety brake means responsive to a cable failure in a relatively rapid manner.

Finally, it is an object of this invention to provide safety brake means usable with a lift apparatus or similar device as an emergency brake that is highly reliable and relatively fast in operation.

These and other objects of this invention are accomplished by providing a lift apparatus comprising a base member, a mast member extending upwardly from the base member and a load carriage in sliding engagement with the mast member. Also provided is hoist means including a cable in load supporting engagement with the load carriage and further including drive means connected to one end of the cable whereby the hoist means is operative to raise and lower the load carriage along the mast member. Brake means is operatively arranged between the load carriage and the mast member for applying a braking force therebetween and for supporting the load carriage on the mast member. The brake means is associated with control means for controlling its operation, the control means including an operating member connected to the brake means and also to first and second actuating means. Each of the actuating means is operative to actuate the operating member which, in turn, moves the brake means from an inoperative position to an operative position. Preferably each of the actuating means actuates the operating member independent of the other. By connecting one actuating means to the cable and the other to an over-speed detector associated with the load carriage the brake can be applied in the event of a cable failure or in the event of other failures providing an over-speed condition.

More particularly, the operating member is pivotally connected intermediate its ends to a portion of the load carriage and is connected at one end to the brake means. The first actuating means includes a first link member connected to the other end of the operating member through a pin and slot arrangement; the second actuating means includes a second actuating link connected to the operating member intermediate the pivotal connection and the one end also through a pin and slot arrangement. Movement of the first actuating link in one direction pivots the operating member and operates the brake means without causing movement of the second actuating link. Similarly, movement of the second actuating link in an opposite direction also pivots the operating member and operates the brake means without causing movement of the first actuating link.

For a better understanding of the invention, reference is made to the following description of a preferred embodiment thereof taken in conjunction with the figures of the accompanying drawing, in which:

FIG. 1 is a side view of a lift apparatus in accordance with this invention;

FIG. 2 is a perspective view of an over-speed detector and its associated brake actuating means usable with the lift apparatus of FIG. 1 with portions omitted for the sake of clarity.

FIG. 3 is a schematic view looking along the line 3-3 of FIG. 1 illustrating a safety brake and actuating means in accordance with this invention.

Referring now to FIG. 1 of the drawing, there is illustrated a lift apparatus 10 including a base member 12 which is associated with a drive mean, not illustrated, for driving the lift apparatus along the ground and which may be movable in a track, not shown, laid in the floor of a warehouse. The track guides the lift apparatus along aisles formed between storage units in the warehouse. The storage units are formed by shelving members stacked one on the other to provide a plurality of vertically extending storage spaces. Of course, the shelving spaces also extend horizontally providing the aisles. Extending upwardly from the base member 12 in a generally vertical direction is a mast member 14 forming a guide for a load carriage 16 which is slidably arranged on the mast member for travel in the vertical direction. The mast member 14 is preferably a box beam structural member, but may also be a channel, an I-beam or any other suitable structural member. For providing additional stability, the upper end of the mast member 14 may also ride in a track, also not shown, adjacent the ceiling of the warehouse so that both the base member and the top of the mast member are slidably supported in a track.

The load carriage 16 includes a cab portion 18 for the operator and a support tray 20 on which parts or other articles are carried. Thus, the operator can travel along the aisles of the warehouse to the desired location and can then ride along the mast until the desired vertical storage space is reached. At this point, the operator can remove goods from the storage space and place them on the support tray 20 or can remove goods from support tray 20 and place them in a storage space. Still referring to FIG. 1 of the drawing, a pair of arm members 28 (only one of which can be seen) extend from the back side of load carriage 16 and include conventional guide arrangements (not shown) which may include rollers or other anti-friction means riding along a rail 29 formed on the mast member 14. For moving the load carriage 16 along the mast member 14 there is provided a hoist mechanism including a motor means 22 driving a drum (not shown) through a gear arrangement and a cable 24. One end of the cable 24 is attached to the drum so that the cable can be wound or unwound with rotation of the drum. From the drum the cable 24 extends upwardly along the side of the mast member 14, passes over a sheave arrangement 26 at the top of the mast member and down the other side of the mast member to the load carriage 16. From the load carriage 16 the cable 24 returns upwardly to the top of the mast member 14 where its other end is fixed. The return of the cable 24 to the top of the mast member 14 cannot be seen in FIG. 1 because it is in a plane in back of the extension of the cable from the sheave arrangement 26 to the load carriage 16. As should be apparent and as will be fully explained hereinafter the cable 24 is in load supporting engagement with the load carriage 16 between the sheave arrangement 26 and the top of the mast member 14 where the cable is fixed so that as the cable unwinds on the drum, the load carriage is lowered and as the cable is wound on the drum, the load carriage is raised.

Adjacent the mast member 14 there is located an overspeed detection device which device is generally conventional and need not be specifically described. To more clearly understand the invention, however, it is noted that the over-speed detection device includes a control cable 30 in the form of an endless loop which extends about an idler wheel 32 at the top of the mast member 14 and about a governor wheel 34 at the bottom of the mast member as seen in FIG. 1 of the drawing. The governor wheel 34 is associated with a governor 36 which is operative to allow movement of the control cable 30 around the wheels 32 and 34 below a predetermined speed and to lock up the cable if its speed exceeds the predetermined speed. An example of such a governor and associated wheel is that sold by F. S. Payne Company of Cambridge, Massachusetts. The function of the over-speed detection device will be more clearly explained hereinafter.

Referring now to FIG. 3 of the drawing, a portion of the load carriage 16 is illustrated including a pair of side frame members **16*a* and 16*b* which members extend generally parallel to the mast member 14. Connected to the frame members 16*a* and 16*b* through pin and slot arrangements 38*a* and 38*b* are a pair of arm members 40*a* and 40*b* which extend toward each other and which carry a collar 42 having a first pair of opposite surfaces 44 and 46 each arranged to be on opposite sides of a rib 48 formed on the mast member 14 and extending toward the back of the load carriage 16. The surface 44 on the collar 42 is inclined so that it is closer to the rib 48 at the end adjacent the top of the collar than it is at the end adjacent the bottom of the collar. The surface 46 is generally parallel to the rib 48 and includes a recess in which a suitable brakeshoe 50 is carried. The brakeshoe 50 is a removable member and can be formed of bronze alloy or other suitable material. Extending downwardly into the space between the inclined surface 44 and the rib 48 is a roller 52 rotatably carried on a link 54. The collar 42 and the roller 52 cooperate with the rib 48 to provide a brake for the load carriage and as illustrated in FIG. 3 the brake is in an inoperative condition. Upward movement of the link 54 causes corresponding upward movement of the roller 52 which rides along the inclined surface 44 and engages the rib 48 causing the collar and the arm members 40*a* and 40*b* to shift slightly at the pin and slot connections 38*a* and 38*b* so that the brakeshoe 50 engages one surface on the rib and so that the roller wedges between the inclined surface and the opposite surface of the rib. Thus, a braking force is applied that will stop the movement of the load carriage 16 along the mast member 14** and the load carriage will be supported on the mast member.

For moving the link 54 and the roller 52 upwardly there is provided a control means including an operating member 56 in the form of a link pivotally connected at one of its ends to the link 54. Intermediate its ends the operating member 56 is carried on a pivot pin 58 connected to some portion of the load carriage so that the operating member can rotate around the pivot pin. When the operating member 56 pivots about the pivot pin in a counterclockwise direction, as viewed in FIG. 3, the link 54 and the roller 52 move upwardly relative to the collar 42 to provide the braking force and support function explained above.

For pivoting the operating member 56 about the pivot pin 58, the control means further includes a first actuating means and a second actuating means each of which operates independent of the other. The first actuating means includes an actuating arm 60 extending across frame members 16*a* and 16*b* and which is pivotally connected at one end to the frame member 16*b*. At the other or free end the actuating arm member 60 is received in a notch 62 formed in the frame member 16*a* such that the notch forms an upper surface 64 providing an upper stop means and a lower surface 66 forming a lower stop means. Thus, pivotal movement of the actuating arm 60 is limited by the surfaces or stop means 64 and 66. Adjacent its free end the actuating arm 60 is connected to a spring member 68 also connected to frame member 16*a* for exerting a force on the actuating arm tending to pivot the arm so that its free end bears on the bottom stop surface 66. Under normal operating conditions, however, the actuating arm 60 is held in the position shown in the drawing with its free end engaged with the upper stop surface 64 by the tension in the hoist cable 24. It will be remembered that hoist cable 24 is in load supporting engagement with the load carriage 16 and this is provided for by locating a pulley 70 on the actuating arm 60 so that the pulley is located along the hoist cable between the sheave arrangement 26 and the top of the mast member 14 where the end of the hoist cable is fixed. It should be realized that if the cable 24 breaks, the tension holding the actuating arm 60 against the upper stop surface 64 is lost and the spring member 64 will rotate the actuating arm about its pivot connection until the arm member engages the lower stop surface 66.

Pivotally connected to the actuating arm 60 adjacent its free end is one end of a first actuating link 72 which is connected at its other end to the operating arm member 56 between the free end thereof and the pivot pin 58 by a pin and slot arrangement. In the embodiment disclosed herein, a slot 74 is formed on the end of the link 72 opposite the actuating arm 60 and the slot receives a pin 76 extending from the operating arm 56. With the actuating arm 60 against the upper stop surface 64 the top surface forming the slot 74 bears on the pin 76. Accordingly, downward movement of the link 72, caused by loss of tension in the hoist cable 24 and movement of the actuating arm 60 from stop surface 64 to stop surface 66, causes the operating arm member 56 to pivot in a counter-clockwise direction, as viewed in FIG. 3, about pivot pin 58. As explained previously, such movement of the operating arm member 56 moves the link 54 and roller 52 upwardly causing the roller to wedge between the inclined surface 44 and the rib 48.

Referring to FIGS. 1 and 2 of the drawing it can be seen that the second actuating means includes an arm member 78 which is fixed at one end to the control cable 30 in the overspeed detection device so that the arm member and the control cable can move in unison. The arm member 78 extends generally parallel to the wall of the mast member 14 adjacent the overspeed detection device and is formed with a notch 80 at its free end on which bears a projection 82 extending from the load carriage 16. A spring member 84 is connected at one end to the arm member 78 and at its other end to a projecting portion of the load carriage 16 (not shown). Thus, the spring member 84 biases the arm member 78 to the position wherein the notch 80 bears on the projection 82. Extending toward the load carriage 16 is an actuating rod 86 one end of which is fixed to the arm member 78 at a point adjacent to the notch 80 and the other end of which is fixed to one end of an actuating arm 88. Intermediate its ends the actuating rod 86 is rotatably carried in a pair of support bearing assemblies 90, 90 which are fixed to a frame portion of the load carriage 16, not shown for the sake of clarity in the drawing.

With the arrangement just described it should be clear that the control cable 30 moves with the load carriage 16 at normal operating speeds. If, however, the speed of the load carriage 16 exceeds the predetermined speed at which the governor 36 locks up the control cable 30, the end of the arm member 78 is fixed to the now motionless control cable. The end of the arm member 78 formed with the notch 80 continues to move with the load carriage 16 causing the arm member to pivot about an axis perpendicular to the control cable 30. Some stretching of the control cable 30 occurs, of course, but this stretching is not considered detrimental. As the arm member 78 pivots it twists the actuating rod 86 about its own longitudinal axis so that the actuating rod rotates in the bearing assemblies 90, 90 and pivots the actuating arm 88. Thus an over-speed condition causes the actuating arm 88 to pivot in a counter-clockwise direction as viewed in FIG. 3 of the drawing.

Referring particularly now to FIG. 3 it can be seen that the second actuating means further includes a second actuating link 92 pivotally connected at one end to the end of the actuating arm 88 opposite the actuating rod 86 and connected at its other end to the operating arm member 56 between the pivot pin 58 and the end of the operating arm member at which the link 54 is connected. The second actuating link 92 is connected to the operating arm member 56 through a pin and slot arrangement. In the embodiment disclosed herein, a slot 94 is formed on the end of the link opposite the actuating arm 88 and receives a pin 96 extending from the operating arm member 56. With the actuating arm 86 in the position illustrated in the drawing, that is, when no over-speed condition has been detected, the pin 96 bears on the bottom surface forming the slot 94. Accordingly, when an over-speed condition is detected the actuating arm 88 pivots in a counter-clockwise direction about the actuating rod 86 and moves the second actuating link 92 upwardly which in turn moves the operating arm member 56 in a counter-clockwise direction about the pivot pin 58. As explained previously, such movement of the operating arm member 56 moves the link 54 and roller 52 upwardly causing the roller to wedge between the inclined surface 44 and the rib 48.

Because of the pin and slot arrangements between the actuating links 72 and 92 with the operating member 56, operation of the brake means by one of the actuating means is independent of the other actuating means. Accordingly, use of one actuating means causes no operational movement of the other. That is, if the first actuating means is used to apply the brake because of the failure of the hoist cable 24, as the operating member 56 is pivoted in a counter-clockwise direction by the first actuating link 72, the pin 96 rides upwardly in the slot 94 in the second actuating link 92 and the latter is not moved. Conversely, if the second actuating link 92 is used to apply the brake because of a failure in the motor 22 or the gearing causing an over-speed condition, as the operating member 56 is pivoted in a counter-clockwise direction by the second actuating link 92, the pin 76 rides downwardly in the slot 74 in the first actuating link 72 and the latter is not moved. With this arrangement, the operational force required to apply the brake through either actuating system is less than if both actuating systems were operational and, further, should one of the actuating means fail, the other can still operate to apply the brake.

From the preceding description of a preferred embodiment of the invention, it can be realized that a braking force can be applied between the load carriage 16 and the mast member 14 in response to a failure of the hoist cable 24 in a rapid manner. Thus, the load carriage 16 does not accelerate to any significant speed that could cause an abrupt stopping of the load carriage. In addition, use of the over-speed detection device and second actuating means provides for the efficient application of a braking force between the load carriage 16 and the mast member 14 in the event of a failure in the motor or gear arrangement causing an over-speed condition. Finally, it is noted that the first and second actuating means merely start the application of the braking force and that when the roller 52 first engages the rib 48 the load carriage 16 is operative to provide the further movement of the roller along the rib and the inclined surface 44 at the same speed as the load carriage. From the time the roller 52 first engages the rib 48 the actuating means do not aid or interfere with the application of the braking force.

While in the foregoing there has been described a preferred embodiment of the invention, it should be understood that various changes and modifications can be made without departing from the true spirit and scope of the invention as recited in the appended claims:

I claim:

1. A lift apparatus comprising a base member; a mast member extending upwardly from said base member; a load carriage associated with said mast member and being in sliding engagement therewith; hoist means including a cable in load supporting engagement with said load carriage, said hoist means further including drive means, one end of said cable being operatively connected to said drive means whereby said hoist means is operative to raise and lower said load carriage along said mast member; brake means operatively arranged between said load carriage and said mast member for applying a braking force therebetween and for supporting said load carriage on said mast member; and, control means for controlling the operation of said brake means, said control means including an operating member connected at one end thereof to said brake means and pivotally connected intermediate its ends to a portion of said load carriage, first actuating means including a first link member operatively connected to the other end of said operating member and second actuating means including a second link member operatively connected to said operating member intermediate said one end and said pivoted connection whereby movement of said first link member in one direction pivots said operating member and operates said brake means and whereby movement of said second link member in the opposite direction pivots said operating member and operates said brake means.

2. A lift apparatus in accordance with claim 1 wherein each of said first and second actuating means are operative to actuate said operating member independent of the other.

3. A lift apparatus in accordance with claim 1 wherein said first and second link members are connected to said operating member through a pin and slot arrangement whereby movement of of one of said link members does not cause movement of the other of said link members.

4. A lift apparatus in accordance with claim 3 wherein said first and second link members are formed with slots and wherein said slots extend in opposite directions.

5. A lift apparatus in accordance with claim 1 wherein said first link member is formed with a first slot and said operating member is formed with a first pin received in and normally bearing on one end of said first slot, said first slot normally extending away from said first pin in said one direction, and wherein said second link member is formed with a second slot and said operating member is formed with a second pin received in and normally bearing on one end of said second slot, said second slot normally extending away from said second pin in said opposite direction whereby movement of said first link member is transmitted to said operating member causing it to pivot such that said second pin member rides freely in said second slot and whereby movement of said second link member is transmitted to said operating member causing it to pivot such that said first pin member rides freely in said first slot.

6. A lift apparatus in accordance with claim 1 wherein said brake means includes a collar extending about a portion of said mast member, one surface of said collar adjacent said mast member being inclined so that one end of said surface is closer to said mast member than the other end thereof, said brake means further including a roller member between said inclined surface and said mast member, said roller member being adjacent said other end of said inclined surface when said brake means is in its inoperative position and being movable to a position adjacent said one end of said inclined surface when said brake means is in its operative position.

7. A lift apparatus in accordance with claim 1 wherein said first actuating means is operatively associated with said cable for moving said brake means from its inoperative position to its operative position if said cable fails.

8. A lift apparatus in accordance with claim 1 wherein said second actuating means is operatively associated with overspeed detection means for moving said brake means from its inoperative position to its operative position if said load carriage exceeds a predetermined speed.

9. A brake system usable with a lift apparatus or similar device including a member traveling on a guide means said brake system comprising a collar member adapted to extend about a portion of said guide member, said collar member including an inclined surface and a generally planar surface, a roller member carried on a link member for movement along said inclined surface, said link member being connected to one end of an operating member, said operating member including pivot means intermediate its end about which said operating member can pivot to provide for the movement of said roller member along said inclined surface, a first actuating link connected to the other end of said operating member, a second actuating link connected to said operating member intermediate said pivot means and said one end thereof whereby movement of said first actuating link in one direction pivots said operating member to provide for the movement of said roller member along said inclined surface and whereby movement of said second actuating link in the opposite direction pivots said operating member to provide for the movement of said roller member.

10. A brake system in accordance with claim 9 wherein said first and second actuating links are connected to said operating member through a pin and slot arrangement whereby movement of one of said actuating links does not cause movement of the other.

11. A brake system in accordance with claim 10 wherein each of said first and second actuating links are formed with a slot and wherein each slot extends in an opposite direction from said operating member when said roller member is adjacent the end of said inclined surface spaced farthest from said generally planar surface.

12. A brake actuation system in accordance with claim 10 wherein each of said first and second actuating links are formed with a slot and wherein each slot extends in an opposite direction from said operating member when the brake means is in an unactuated position.

13. A brake actuation system usable with a lift apparatus or similar device including a member travelling on a guide means, and brake means operatively disposed between the member and the guide means for stopping motion of the member, the brake actuation system comprising:

an operating member connected adjacent one end thereof to the brake means including pivot means intermediate its ends about which said operating member can pivot to actuate the brake means;

a first actuating link connected adjacent the other end of said operating member; and a second actuating link connected to said operating member intermediate said pivot means and said one end thereof, whereby movement of said first actuating link in one direction pivots said operating member to actuate the brake means and whereby movement of said second actuating link in the opposite direction pivots said operating member to actuate the brake means.

14. A brake actuation system in accordance with claim 13 wherein said first and second actuating links are connected to said operating member through a pin and slot arrangement whereby movement of one of said actuating links does not cause movement of the other.

* * * * *